US006056598A

United States Patent [19]

Ramsey

[11] Patent Number: 6,056,598

[45] Date of Patent: May 2, 2000

[54] COLLAPSIBLE PRINTER CABLE PLUG

[76] Inventor: Keith P. Ramsey, 9716 S. 2810 West, South Jordan, Utah 84095

[21] Appl. No.: 09/160,161

[22] Filed: Sep. 25, 1998

[51] Int. Cl.[7] ..... H01R 13/40

[52] U.S. Cl. ..... 439/596; 439/701

[58] Field of Search ..... 439/586, 595, 439/596, 35, 701, 714, 31, 467

[56] References Cited

U.S. PATENT DOCUMENTS 3,474,376 10/1969 Preiss ..... 439/31
5,478,243 12/1995 Hopkins et al. ..... 439/35
5,688,144 11/1997 Kosuge ..... 439/596
5,716,235 2/1998 Endo et al. ..... 439/596
5,921,807 7/1999 Okabe ..... 439/596

*Primary Examiner*—Hien Vu

[57] ABSTRACT

A collapsible port adapter is provided including a cable connected to an adapter head which includes at least a pair of portions which are collapsible. The portions of the adapter head are capable of a first orientation for reducing a size of the adapter head to pass through a small opening and a second orientation for allowing the same to be connected to a port.

9 Claims, 2 Drawing Sheets

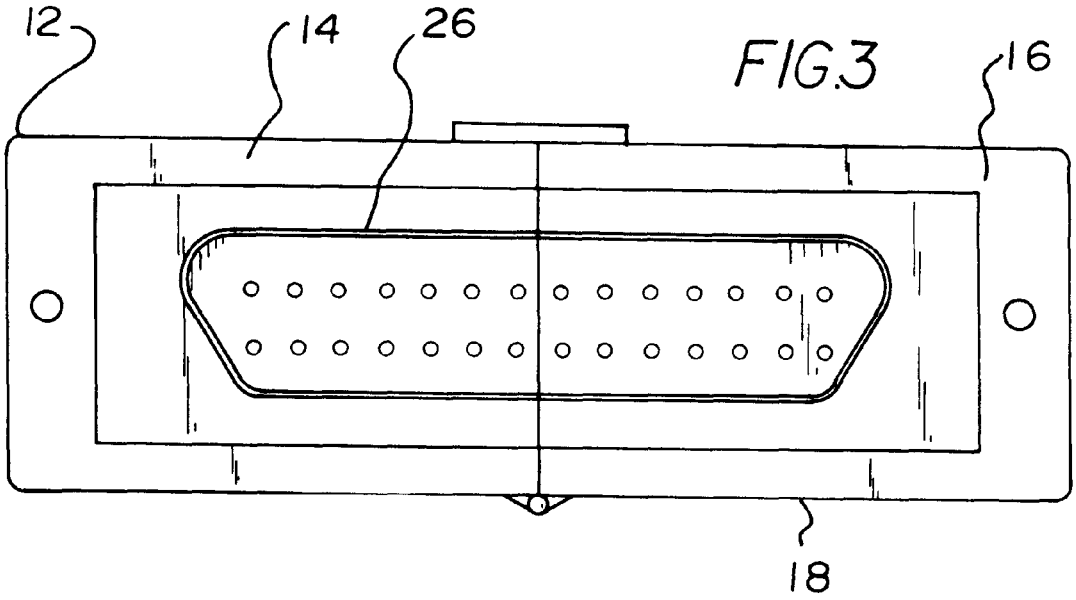
FIG.3
FIG.4
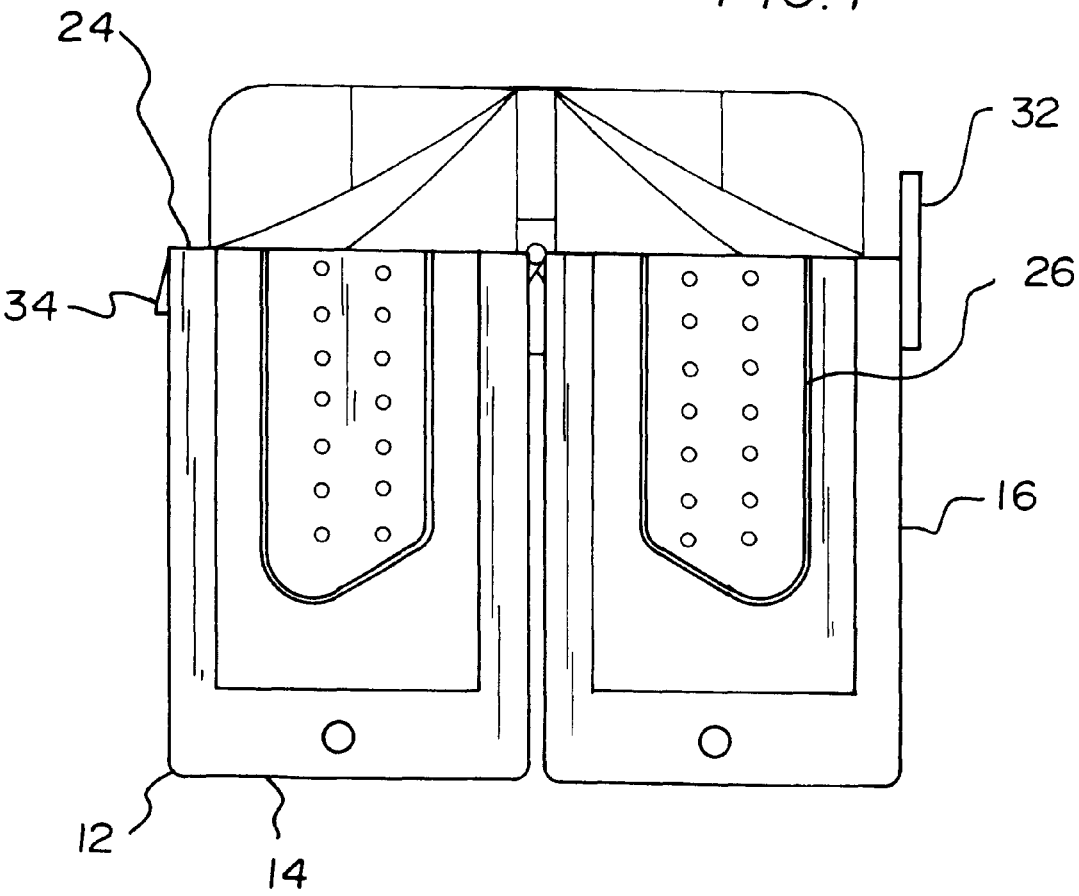

COLLAPSIBLE PRINTER CABLE PLUG

BACKGROUND OF THE INVENTION

1. Field of the Invention

The present invention relates to computer adapters and more particularly pertains to a new collapsible printer cable plug for passing a parallel port adapter through a small opening in a desk, table or the like.

2. Description of the Prior Art

The use of computer adapters is known in the prior art. More specifically, computer adapters heretofore devised and utilized are known to consist basically of familiar, expected and obvious structural configurations, notwithstanding the myriad of designs encompassed by the crowded prior art which have been developed for the fulfillment of countless objectives and requirements.

Known prior art computer adapters and the like include U.S. Pat. No. 5,167,523; U.S. Pat. No. 5,498,165; U.S. Pat. No. 4,802,605; U.S. Pat. Des. 317,291; U.S. Pat. No. 3,474,376; and U.S. Pat. No. 5,435,744.

In these respects, the collapsible printer cable plug according to the present invention substantially departs from the conventional concepts and designs of the prior art, and in so doing provides an apparatus primarily developed for the purpose of passing a parallel port adapter through a small opening in a desk, table or the like.

SUMMARY OF THE INVENTION

In view of the foregoing disadvantages inherent in the known types of computer adapters now present in the prior art, the present invention provides a new collapsible printer cable plug construction wherein the same can be utilized for passing a parallel port adapter through a small opening in a desk, table or the like.

The general purpose of the present invention, which will be described subsequently in greater detail, is to provide a new collapsible printer cable plug apparatus and method which has many of the advantages of the computer adapters mentioned heretofore and many novel features that result in a new collapsible printer cable plug which is not anticipated, rendered obvious, suggested, or even implied by any of the prior art computer adapters, either alone or in any combination thereof.

To attain this, the present invention generally comprises an adapter head constructed from a rigid plastic. Such adapter head includes a pair of halves each with a planar top face, a planar bottom face, a rear face, a front face and a pair of side faces. As shown in the Figures, the top face and bottom face of each half of the adapter head has a length which is less than twice a width of each side face. Each front face of each half of the adapter head has a connector protrusion extending therefrom with a reduced area. As shown in FIGS. 3 & 4, each connector protrusion is equipped with a planar top surface, a planar bottom surface, a planar inner surface in coplanar relationship with a first one of the side faces of the corresponding half and a tapering arcuate outer surface. Further, the connector protrusion has an array of connectors mounted thereon. A second one of the side faces of each half of the adapter head has an ear coupled thereto and extending therefrom in perpendicular relationship with the second side face. A bore is formed in each car for receiving a threaded fastener. As shown in FIGS. 1 & 4, the top face of a first one of the halves has a U-shaped latch coupled thereto and extending from the first side face thereof. Associated therewith is a triangular tab coupled to the top face of a second one of the halves. In use, the halves of the adapter head arc hingably coupled along a bottom edge of the first side faces thereof. As such, the halves of the adapter head may be pivoted between a first orientation with the bottom faces of the halves in abutment. In such orientation, the adapter head may be passed through a small opening in a desk, table or the like. The halves of the adapter head are further capable of a second orientation with the first side faces locked together via the latch and tab. As such, the inner surfaces of the connector protrusion remain in abutment so that the connector protrusion may be releasably connected to a parallel port of a computer or printer or other hardware accessory. Finally, a grommet is provided which is constructed from a flexible elastomeric material. The grommet includes a front tapering portion connected to the rear faces of the halves of the adapter head. A rear rectilinear portion of the grommet is integrally coupled to the front tapering portion and extends rearwardly therefrom for receiving a sleeved cable. The front tapering portion of the grommet is equipped with a slit formed in a top face thereof. The slot preferably extends to a point adjacent to a bottom face of the front tapering portion of the grommet. Further, the slit terminates at the rear rectilinear portion for defining a pair of side extents. Two bunches of electrical wires are each connected between the connectors of one of the halves of the adapter head and the cable. While not shown, the connectors preferably extend through one of the side extents of the front tapering portion of the grommet. In use, the side extents of the grommet may be resiliently contorted when the halves of the adapter head are in the first orientation thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible printer cable plug apparatus and method which has many of the advantages of the computer adapters mentioned heretofore and many novel features that result in a new collapsible printer cable plug which is not anticipated, rendered obvious, suggested, or even implied by any of the prior art computer adapters, either alone or in any combination thereof.

It is another object of the present invention to provide a new collapsible printer cable plug which may be easily and efficiently manufactured and marketed.

It is a further object of the present invention to provide a new collapsible printer cable plug which is of a durable and reliable construction.

An even further object of the present invention is to provide a new collapsible printer cable plug which is susceptible of a low cost of manufacture with regard to both materials and labor, and which accordingly is then susceptible of low prices of sale to the consuming public, thereby making such collapsible printer cable plug economically available to the buying public.

Still yet another object of the present invention is to provide a new collapsible printer cable plug which provides in the apparatuses and methods of the prior art some of the advantages thereof, while simultaneously overcoming some of the disadvantages normally associated therewith.

Still another object of the present invention is to provide a new collapsible printer cable plug for passing a parallel port adapter through a small opening in a desk, table or the like.

Even still another object of the present invention is to provide a new collapsible printer cable plug that includes a cable connected to an adapter head which includes at least a pair of portions which are collapsible. The portions of the adapter head are capable of a first orientation for reducing a size of the adapter head to pass through a small opening and a second orientation for allowing the same to be connected to a port.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the present invention in the second orientation thereof.

FIG. 4 is a front view of the present invention in the first orientation thereof.

DESCRIPTION OF THE PREFERRED EMBODIMENT

Figure 1:
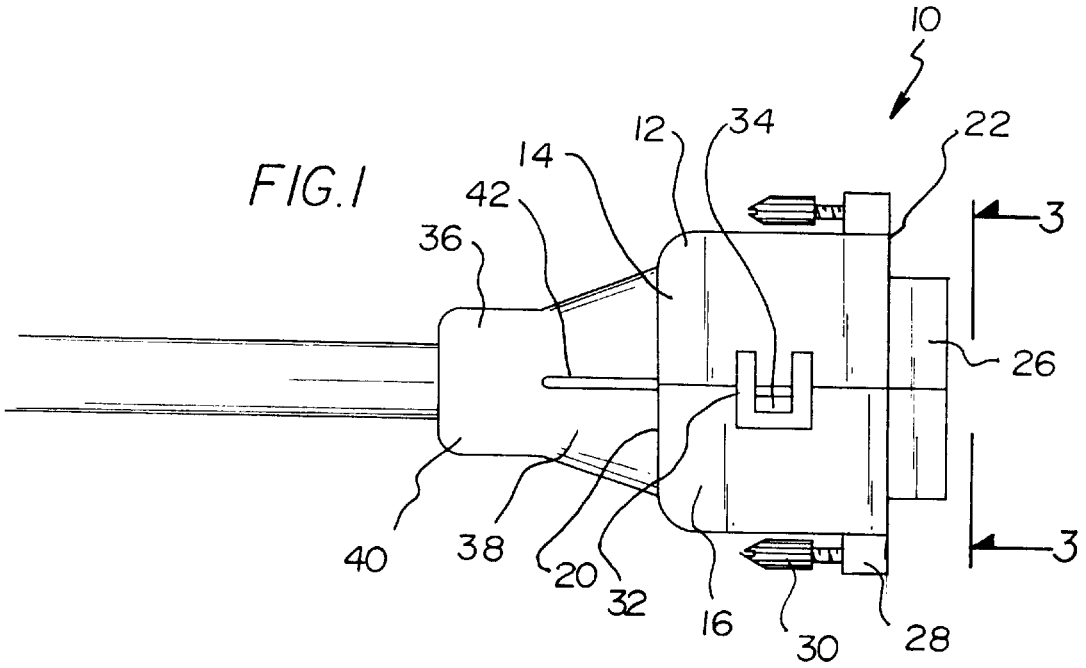
FIG. 1 is a top view of the adapter head of the present invention in the second orientation thereof.
Figure 2:
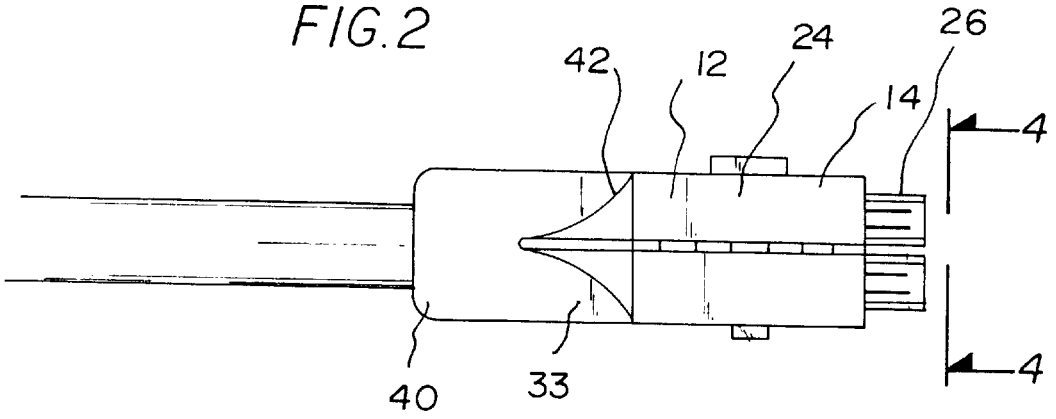
FIG. 2 is a top view of the adapter head of the present invention in the first orientation thereof.

With reference now to the drawings, and in particular to FIGS. 1 through 4 thereof, a new collapsible printer cable plug embodying the principles and concepts of the present invention and generally designated by the reference numeral 10 will be described.

The present invention, designated as numeral 10, includes an adapter head 12 constructed from a rigid plastic. Such adapter head includes a pair of halves 14 of equal size. Each half of the adapter head has a planar top face 16, a planar bottom face 18, a rear face 20, a front face 22 and a pair of side faces 24. As shown in the Figures, the top face and bottom face of each half of the adapter head has a length which is less than twice a width of each side face.

Each front face of each half of the adapter head has a connector protrusion 26 extending therefrom with a reduced cross-sectional area. As shown in FIGS. 3 & 4, each connector protrusion is equipped with a planar top surface, a planar bottom surface, a planar inner surface in coplanar relationship with a first one of the side faces of the corresponding half and a tapering arcuate outer surface. Further, the connector protrusion has an array of connectors mounted thereon. It should be noted that the connectors may be of the female or the male type.

A second one of the side faces of each half of the adapter head has an ear 28 coupled thereto and extending therefrom in perpendicular relationship with the second side face. A bore is formed in each car for receiving a threaded fastener 30. Preferably, the threaded fastener is freely rotatable within the bore formed in the associated ear. As shown in FIGS. 1 & 4, the top face of a first one of the halves has a U-shaped latch 32 coupled thereto and extending from the first side face thereof. Associated therewith is a triangular tab 34 coupled to the top face of a second one of the halves.

In use, the halves of the adapter head are hingably coupled along a bottom edge of the first side faces thereof. As such, the halves of the adapter head may be pivoted between a first orientation with the bottom faces of the halves in abutment. In such orientation, the adapter head may be passed through a small opening in a desk, table or the like. The length of the adapter head, which is conventionally about 2 and ½ inches, is reduced to half. The halves of the adapter head are further capable of a second orientation with the first side faces locked together via the latch and tab. As such, the inner surfaces of the connector protrusion remain in abutment so that the connector protrusion may be releasably connected to a parallel port of a computer, printer or other hardware accessory.

Finally, a grommet 36 is provided which is constructed from a flexible elastomeric material. The grommet includes a front tapering portion 38 connected to the rear faces of the halves of the adapter head. A rear rectilinear portion 40 of the grommet is integrally coupled to the front tapering portion and extends rearwardly therefrom for receiving a sleeved cable.

The front tapering portion of the grommet is equipped with a slit 42 formed in a top face thereof. The slot preferably extends to a point adjacent to a bottom face of the front tapering portion of the grommet to define a living hinge. Further, the slit terminates at the rear rectilinear portion for defining a pair of side extents. Two bunches of electrical wires are each connected between the connectors of one of the halves of the adapter head and the cable. While not shown, the connectors preferably extend through one of the side extents of the front tapering portion of the grommet. In use, the side extents of the grommet may be resiliently contorted when the halves of the adapter head are in the first orientation thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible parallel port adapter for movement through a relatively small opening in an object such as a desk, the collapsible parallel port adapter comprising, in combination:

an adapter head constructed from a rigid plastic and including a pair of halves each with a planar top face, a planar bottom face, a rear face, a front face and a pair of side faces, the top face and bottom face of each half having a length which is less than twice a width of each side face, each front face of each half having a connector protrusion with a planar top surface, a planar bottom surface, a planar inner surface in coplanar relationship with a first one of the side faces of the corresponding half and a tapering arcuate outer surface, the connector protrusion having an array of connectors mounted thereon, a second one of the side faces of each half having an ear coupled thereto and extending therefrom in perpendicular relationship with the second side face with a bore formed therein for receiving a threaded fastener, the top Face of a first one of the halves having a U-shaped latch coupled thereto and extending from the first side face thereof, the top face of a second one of the halves having a triangular tab coupled thereto adjacent the first side face thereof, wherein the halves of the adapter head are hingably coupled along a bottom edge of the first side faces thereof such that the halves may be pivoted between a first orientation with the bottom faces of the halves in abutment for allowing the adapter head to pass through the small opening, and a second orientation with the first side faces locked together via the latch and tab such that the inner surfaces of the connector protrusion remain in abutment so that the connector protrusion may be releasably connected to a parallel port; and a grommet constructed from a flexible elastomeric material including a front tapering portion connected to the rear faces of the halves of the adapter head and a rear rectilinear portion integrally coupled to the front tapering portion and extending rearwardly therefrom for receiving a sleeved cable, the front tapering portion having a slit formed in a top face thereof which extends adjacent to a bottom face of the front tapering portion of the grommet and further terminates at the rear rectilinear portion for defining a pair of side extents, wherein two bunches of electrical wires are covered by the grommet and each of the bunches of electrical wires is connected between the connectors of one of the halves of the adapter head and the cable and extend through one of the side extents of the front tapering portion of the grommet, wherein the side extents may be resiliently contorted when the halves of the adapter head are in the first orientation thereof.

2. A collapsible port adapter for movement through a relatively small opening in an object such as a desk, the collapsible parallel port adapter comprising:

a cable;

an adapter head connected to the cable including at least a pair of portions which are collapsible with a first orientation for reducing a size of the adapter head;

the pair of portions each having a top face, a bottom face, and a pair of side faces, the top face of a first one of the portions having a latch mounted on the top face and extending from a first of the side faces of the first portion, the top face of a second one of the portions having a tab coupled to the top face adjacent a first of the side faces of the second portion, wherein the portions of the adapter head are pivotally coupled together such that the portions may be pivoted between a first orientation with the bottom faces of the portions substantially in abutment for permitting the portions of the adapter head to pass through the small opening, and a second orientation with the first side faces locked together via the latch and tab; and a flexible grommet including a front tapering portion integrally formed with rear faces of the portions of the adapter head and a rear portion integrally coupled to the front portion of the grommet, the rear portion of the grommet extending rearwardly from the front portion of the grommet for covering a portion of the cable, the front portion of the grommet having a slit formed therein which terminates at the rear portion, the slit defining a pair of side extents of the grommet, wherein the side extents may be resiliently contorted when the portions of the adapter head are pivoted from the second orientation to the first orientation of the adapter head.

3. A collapsible port adapter as set forth in claim 2 wherein each portion of the adapter head has a part of a connector protrusion mounted thereon such that the parts of the connector protrusion remain in linear alignment when the portions of the adapter head are in the second orientation.

4. A collapsible port adapter as set forth in claim 2 wherein the portions of the adapter head are coupled together by a hinge.

5. A collapsible port adapter as set forth in claim 4 wherein pivoting of the halves at the hinged coupling into the first orientation permits the reduction of a lateral length of the adapter head to approximately half of the lateral length of the adapter head in the second orientation.

6. A collapsible port adapter as set forth in claim 2 wherein the portions of the adapter head each have couples for allowing the snap coupling thereof in the second orientation.

7. A collapsible port adapter for movement through a relatively small opening in an object such as a desk, the collapsible port adapter comprising:

a cable;

an adapter head including a pair of halves each with a top face, a bottom face, a rear face, a front face and a pair of side faces, each front face of each half having a connector with a top surface, a bottom surface, an inner surface in coplanar relationship with a first one of the side faces of the corresponding hall and an outer surface, the connector having an array of connectors mounted thereon, the top face of a first one of the halves having a U-shaped latch coupled to the top face and extending from the first side face of the first half, the top face of a second one of the halves having a tab coupled to the top face adjacent the first side face of the second half, wherein the halves of the adapter head are hingably coupled along a bottom edge of the first side faces of the halves such that the halves may be pi voted between a first orientation with the bottom faces of the halves in abutment for permitting the halves of the adapter head to pass through the small opening, and a second orientation with the first side faces locked together via the latch and tab such that the inner surfaces of the connector protrusion remain in abutment so that the connector may be releasably connected to a port; and a grommet constructed from a flexible elastomeric material including a front tapering portion integrally formed with the rear faces of the halves of the adapter head and a rear portion integrally coupled to the front portion and extending rearwardly therefrom for covering a portion of the cable, the front portion having a slit formed in a top face of the front portion which extends adjacent to a bottom face of the front portion of the groin met and further terminates at the rear portion, the slit defining a pair of side extents, wherein the side extents may be resiliently contorted when the halves of the adapter head are pivoted from the second orientation to the first orientation of the adapter head.

8. The collapsible port adapter of claim 7 wherein the top face and bottom face of each half of the adapter head have a length which is less than twice a width of each side face of each half of the adapter head.

9. The collapsible port adapter of claim 7 wherein a second one of the side faces of each half of the adapter head has an ear coupled thereto, each of the ears extending from the second side face in perpendicular relationship with the second side face, each of the ears having a bore formed therein for receiving a threaded fastener.

* * * * *